US006321562B1

(12) United States Patent
Narahara et al.

(10) Patent No.: US 6,321,562 B1
(45) Date of Patent: Nov. 27, 2001

(54) EVAPORATOR OF AUTOMOTIVE AIR-CONDITIONER

(75) Inventors: Mitsunori Narahara; Toru Asanuma; Takayuki Kume, all of Tochigi (JP)

(73) Assignee: Calsonic Kansei Corporation, Tokyo (JP)

( * ) Notice: Subject to any disclaimer, the term of this patent is extended or adjusted under 35 U.S.C. 154(b) by 0 days.

(21) Appl. No.: 09/605,537

(22) Filed: Jun. 29, 2000

(30) Foreign Application Priority Data

Jun. 29, 1999 (JP) ..... 11-183843

(51) Int. Cl.[7] ..... F25B 43/00
(52) U.S. Cl. ..... 62/503; 165/153
(58) Field of Search ..... 62/503, 198, 524, 62/525, 509, 527, 515; 165/153, 41

(56) References Cited

U.S. PATENT DOCUMENTS

| | | | | |
|---|---|---|---|---|
| 4,149,390 | | 4/1979 | Iijima et al. | 62/524 |
| 4,353,224 | * | 10/1982 | Nonogaki et al. | 62/515 |
| 5,062,477 | * | 11/1991 | Kadle | 165/174 |
| 5,295,532 | | 3/1994 | Hughes | 165/76 |
| 5,634,349 | * | 6/1997 | Kakehashi et al. | 62/198 |
| 5,701,760 | * | 12/1997 | Torigoe et al. | 62/524 |
| 5,931,020 | * | 8/1999 | Nakamura | 62/527 |
| 5,983,999 | * | 11/1999 | Ito et al. | 165/153 |
| 5,984,000 | * | 11/1999 | Nakamura et al. | 165/153 |
| 6,047,769 | * | 4/2000 | Shimoya et al. | 165/153 |
| 6,070,428 | * | 6/2000 | Higashiyama et al. | 62/525 |
| 6,098,703 | * | 8/2000 | Yoshii | 165/153 |
| 6,129,144 | * | 10/2000 | Bousquet | 165/153 |
| 6,239,787 | * | 5/2001 | Koga et al. | 165/41 |
| 6,250,103 | * | 6/2001 | Watanabe et al. | 62/509 |

FOREIGN PATENT DOCUMENTS

| | | | | |
|---|---|---|---|---|
| 19718355 | * | 12/1997 | (DE) | F24F/3/16 |
| 62-798 | | 1/1987 | (JP) . | |
| 7-39895 | | 5/1995 | (JP) . | |
| 2000283603 | * | 1/2000 | (JP) . | |

OTHER PUBLICATIONS

WPI & JAPIO Abstract for JP 110337293 A, "Evaporator header has a constriction 8 in a partition 9", 2 pages, Dec. 10, 1999.

* cited by examiner

*Primary Examiner*—Teresa Walberg
*Assistant Examiner*—Leonid M Fastovsky
(74) *Attorney, Agent, or Firm*—Foley & Lardner

(57) ABSTRACT

An evaporator for an automotive air conditioner includes first to fourth tank passages connected to a core to flow refrigerant in the order of the first tank passage, the core, the second tank passage, the third tank passage, the core and the fourth tank passage. A choke portion is installed in the fourth tank passage to restrict the flow rate at a part of refrigerant passages of the core. This evaporator is improved in cooling capacity and in capacity for reducing noises.

10 Claims, 17 Drawing Sheets

EVAPORATOR OF AUTOMOTIVE AIR-CONDITIONER

BACKGROUND OF THE INVENTION

The present invention relates to improvements in an evaporator for an automotive air-conditioner.

Generally, an automotive air-conditioner comprises an evaporator for cooling air employed for air conditioning by evaporating refrigerant in the evaporator. Various types of evaporators have been proposed and in practical use. Japanese Patent Publication (Heisei) No. 7-39895 discloses an evaporator constituted by a plurality of heat-transfer tube plates made from a pair of pressed metal plates. As shown in FIGS. 22 and 23, this conventional evaporator 101 is constituted by a core 111 having a plurality of U-shaped refrigerant passages and corrugated fins, and first to fourth tank passages 103 to 106. The core 111 is separated into first and second cores. Refrigerant is supplied from a refrigerant inlet 107 to the first tank passage 103, and flows through the U-shaped refrigerant passages 102*a* of the first core, the second tank passage 104, the third tank passage 105, the U-shaped refrigerant passage 102*b* of the second core in the order of mention. Thereafter, the vaporized refrigerant due to heat exchanger in the core 111 flows out through a refrigerant outlet 108 installed to the fourth tank passage 106. This conventional evaporator 101 is arranged to provide choke portions 112 in the first and third tank passages 103 and 105 so that the refrigerant is equivalently distributed to the heat-transfer tube elements.

SUMMARY OF THE INVENTION

However, there is a possibility that this conventional evaporator 101 may generate noise due to the refrigerant flow in the third tank passage 105. More specifically, in the third passage 105, the refrigerant flow from the second passage 104 to projecting inlets of the heat-transfer tube elements will become complex, and a further installation of the choke plate 112 in the third tank passage 105 will further increase the noise due to the refrigerant flow in the third tank passage 105. Further, there is another possibility that the conventional evaporator 101 may degrade its cooling performance by the provision of the choke plate 112 in the third tank passage 105.

It is therefore an object of the present invention to provide an improved evaporator which improves its performances in reducing noise and in cooling capacity.

An evaporator according to the present invention is for an automotive air conditioner. The evaporator comprises first and second cores, first to fourth tank passages, refrigerant inlet and outlet, and a choke portion. The first core has a plurality of first refrigerant passages and a plurality of first air passages contacted with the refrigerant passages. The second core has a plurality of second refrigerant passages and a plurality of second air passages contacted with the refrigerant passages. The first tank passage is connected to inlets of the first refrigerant passages of the first core, and the second tank passage is connected to outlets of the first refrigerant passages of the first core. The third tank passage is connected to the second tank passage and inlets of the second refrigerant passages of the second core, and the fourth tank passage is connected to outlets of the second refrigerant passages of the second core. The refrigerant inlet is connected to the first tank passage, and the refrigerant outlet is connected to the second tank passage. The choke portion is installed in the fourth tank passage.

DETAILED DESCRIPTION OF THE INVENTION

Figure 1:
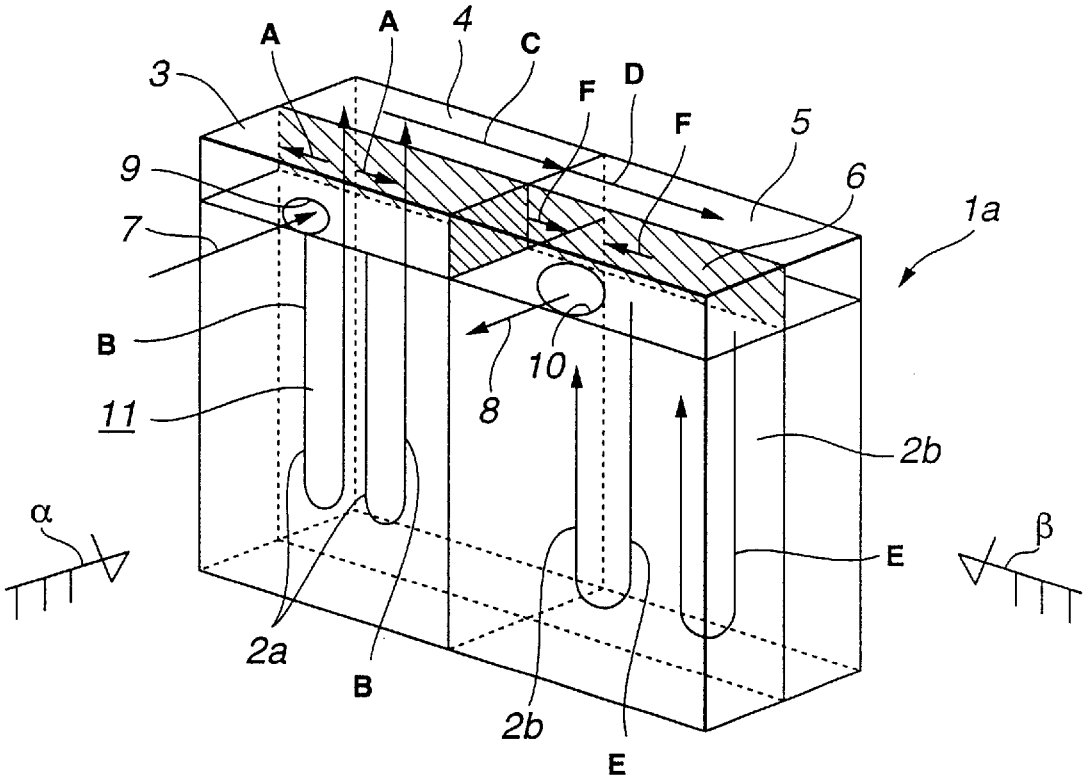
FIG. 1 is a schematic view showing refrigerant flow in an evaporator of a first embodiment according to the present invention.
Figure 2:
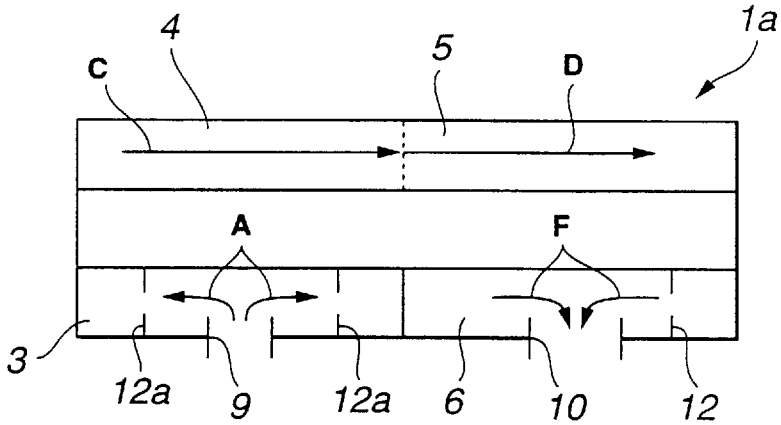
FIG. 2 is a top view showing a flow direction of refrigerant in tank passages of FIG. 1.

Referring to FIGS. 1 to 14, there is shown a first embodiment of an evaporator 1*a* for an air-conditioner of an automotive vehicle in accordance with the present invention.

The evaporator 1*a* of the first embodiment is a laminated type constituted by a core portion 11 and first to fourth tank portions 3 to 6. This laminated type evaporator 1*a* is produced by laminating (arranging in tandem) a plurality of heat-transfer tube elements 13 and a plurality of corrugated fins alternately and by connecting a refrigerant inlet pipe 7 and a refrigerant outlet pipe 8 to the core portion 11. The heat-transfer tube elements 13 and the first to fourth tank passages 3 to 6 are made from a plurality of metal plates 14.

Each heat-transfer tube element 13 is constituted by a pair of the metal plates 14. The evaporator 1*a* is produced by laminating the pairs of metal plates 14 and air fins alternately and by assembling the inlet pipe 7 and the outlet pipe 8 to the core portion 11 and by brazing the assembled core portion 11 and the inlet and outlet pipes 7 and 8 integrally.

The metal plates 14 are basically formed into a shape by means of press-form and are made from a so-called clad sheet which is constituted by laminating brazing sheets on both surfaces of a core sheet. The core sheet is made of aluminum alloy having a relatively high melting point, and the brazing sheet is made of an aluminum alloy which contains a large quantity of Si (silicon) and has a relatively low meting point.

Figure 3:
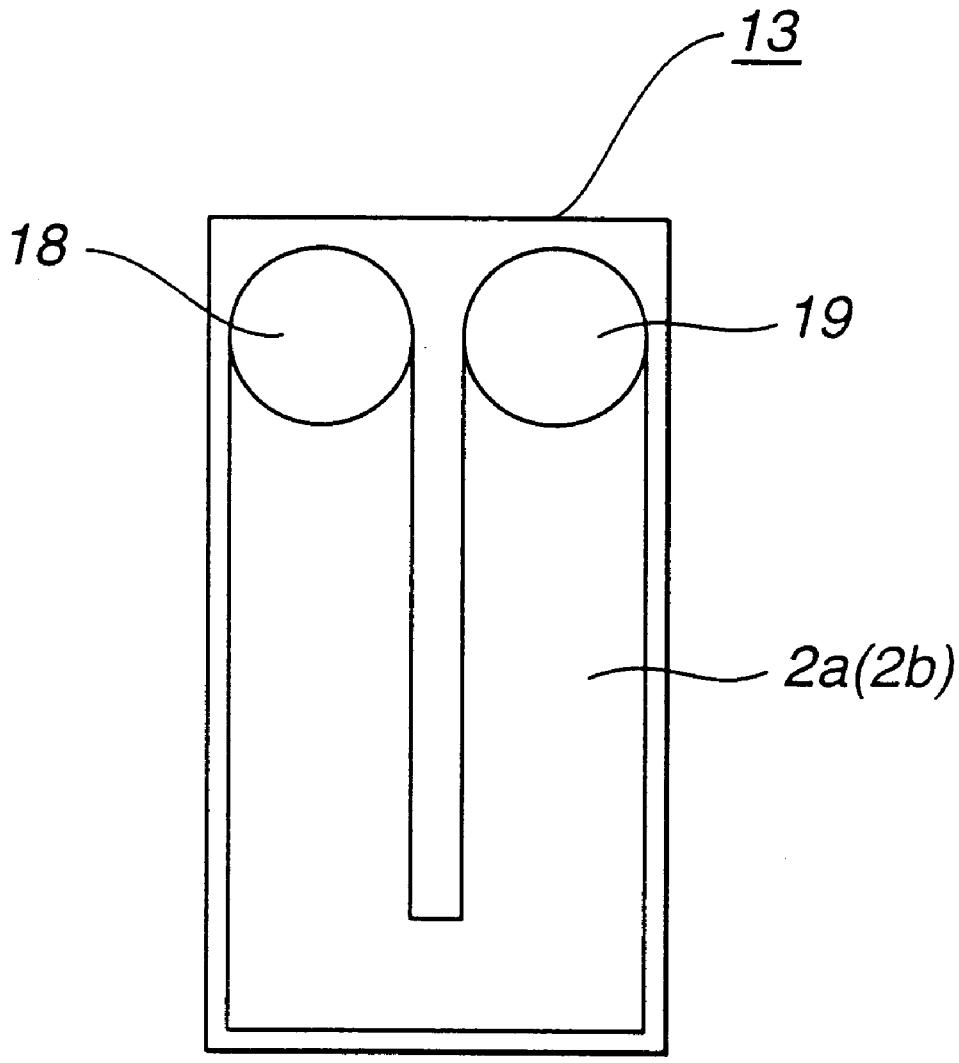
FIG. 3 is a cross-sectional view of a heat-transfer tube element employed in the evaporation of FIG. 1.
Figure 4A:
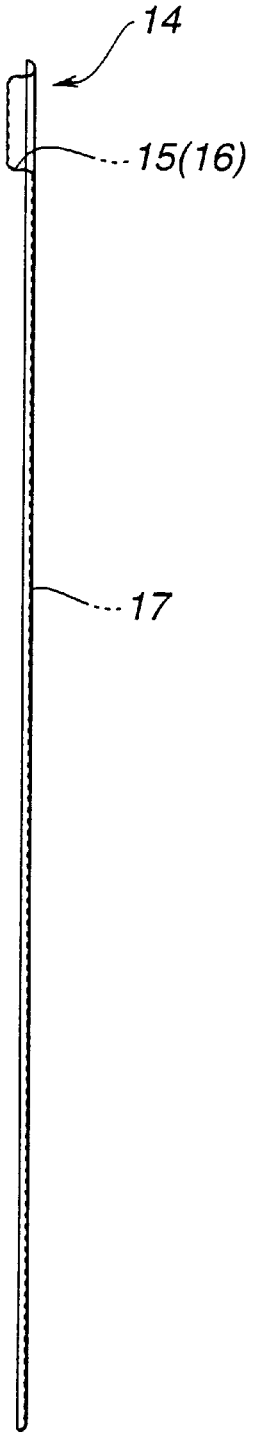
FIG. 4*a* is a side view of a metal plate constituting a heat-transfer tube element of the evaporator, taken in the direction of an arrow a of FIG. 1.
Figure 4B:
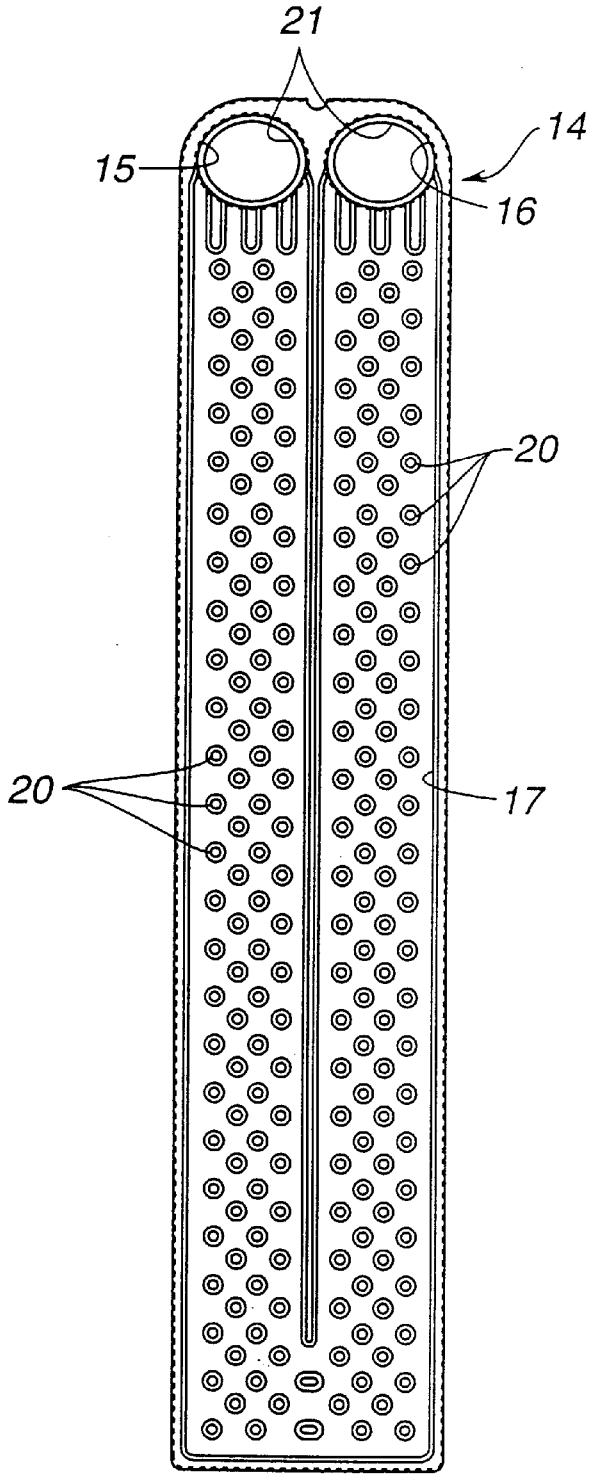
FIG. 4*b* is a plan view of the metal plate of the evaporator, taken in the direction of an arrow β of FIG. 1.

As shown in FIGS. 3 and 4, the heat-transfer tube element 13 is produced by oppositely stacking the pair of metal plate 14 so that the depress portions of the pair of metal plates 14 form a refrigerant passage of a flat tube shape therebetween. The metal plate 14 has first and second deep depressed portions 15 and 16 of an annular shape and a shallow depressed portion 17 of a U-shaped, as shown in FIGS. 4A and 4B. Each pair of the metal plates 14 are miller-symmetrically arranged, and both peripheral surfaces for defining the depressed portions 15, 16 and 17 are fitted with each other to define inlet and output ports functioning as the first and second tank portions 3 and 4 or third and fourth tank portions 5 and 6 and a refrigerant passage functioning as the upstream passage 2*a* or downstream passage 2*b*. The inlet and outlet ports 18 and 19 are continuous to both end portions of the U-shaped refrigerant passage defined by each pair of the shallow depressed portions 17 of the pair of heat-transfer tube elements 13. A first tank chamber 18 is defined by the pair of the first deep depressions 15 oppositely fitted, and a second tank chamber 19 is defined by the pair of the second deep depressions 16 oppositely fitted.

Further, the upstream and downstream passages 2*a* and 2*b* are defined by the pair of the shallow depressed portions 17 oppositely fitted. As is clear from FIG. 3, the inlet and outlet of the U-shaped passage functioning as the upstream or downstream passage 2*a* or 2*b* are connected to the first tank chamber 18 and the second tank chamber 19, respectively. In other words, the first and second tank chambers 18 and 19 are fluidly communicated with each other through the U-shaped passage functioning as the upstream and downstream passages 2*a* and 2*b*.

As is clearly shown in FIG. 4B, a plurality of embossed portions 20 are formed on the shallow depressed portion 17 of the metal plate 14. The embossed portions 20 project from the bottom surface of the shallow depressed portion 17 to an opposite direction of the depressed portions 17, 18 and 19 corresponding to a front direction of the paper of FIG. 4B. Therefore, when the pair of metal plates 14 are fitted and brazed, the embossed portions 20 of one of the metal plate 14 are fixedly connected to the embossed portions 20 of the other of the metal plate 20 by means of brazing, respectively. These embossed portions 20 fixed to the opposite embossed portions 20 function to improve the pressure proof of the heat-transfer tube element 13 and to promote a turbulence of the flow of the refrigerant flowing through the heat-transfer element.

The core portion 11 of the evaporator 1*a* is constituted by alternately laminating the heat-transfer tube elements 13 and the outer fins. Each heat-transfer tube element 13 is connected to adjacent two heat-transfer tube elements 13 through the first and second tank chambers 18 and 19. The first tank chambers 18 are connected to adjacent first tank chambers define first, second, third and fourth tank passages 3, 4, 5 and 6.

More specifically, the first tank chambers 18 of a first half core (a left half portion in FIGS. 1 and 2 of the core portion 11) define the first tank passage 3. A through holes 21 for flowing the refrigerant is opened at each first deep depressed portion 15 except that both of the first deep depressed portions 15 of the two metal plates 14 installed at rightmost and leftmost ends portions of the first half core are closed. Further, in order to define two choke portions 12*a* in the first tank passage 3, two first deep depressed portions 18 located at first and second central portions to provide the choke portions are opened to form small holes 21*a*, respectively. The first and second central portions are located between a central portion and a leftmost end portion of the first half core and between the central portion and a rightmost end portion of the first half core, respectively. Furthermore, the refrigerant inlet pipe 7 is installed at the central portion of the first tank passage 3 while a refrigerant inlet port 9 is formed at the central portion of the first tank passage 3. Therefore, the refrigerant is supplied to the first tank passage 3 through the refrigerant inlet port 9 and flows in the lateral directions in the first tank passage 3. Further, the passages defined by the heat-transfer tube elements 13 function as the upstream passages 2*a*. Accordingly, the upstream end portion of each upstream passage 2*a* is continuously connected to the first tank passage 3.

The second tank chambers 19 of the first half portion of the core portion 11 define the second tank passage 5 by continuously communicating the adjacent second tank chambers 18. That is, a through hole 21 for flowing the refrigerant is opened at each second deep depressed portion 16 except that the second deep depressed portions 16 of the metal plate 14 installed at the leftmost end of the first half core is closed. The passages defined by the heat-transfer tube elements 13 function as the upstream passages 2*a*, and the downstream end portion of each upstream passage 2*a* is continuously connected to the second tank passage 4. The second tank passage 4 flows the refrigerant horizontally toward the third tank passage 5.

Further, the second tank chambers 19 of a second half core (a right half portion in FIGS. 1 and 2 of the core portion 11) define the third tank passage 5. A through hole 21 for flowing the refrigerant is opened at each second deep depressed portion 16 except that the second deep depressed portion 16 of the metal plates 14 installed at the rightmost portion of the second half core are closed. Therefore, the refrigerant supplied from the second tank passage 4 flows in the third tank passage 5 in the lateral direction of the evaporator 1*a*. The passages defined by the heat-transfer tube elements 13 of the second half core function as the downstream passages 2*b*, and the upstream end portion of each downstream passage 2*b* is continuously connected to the third tank passage 5.

The first tank chambers 18 of the second half portion of the core portion 11 define the fourth tank passage 6 by continuously communicating the adjacent first tank chambers 18. That is, a through hole 21 for flowing the refrigerant is opened at each first deep depressed portion 16 except that the first deep depressed portions 15 of the metal plate 14 installed at the rightmost end of the second half core is closed. The refrigerant outlet pipe 8 is connected to an intermediate portion of the fourth tank passage 6 while a refrigerant outlet port 10 is formed at the intermediate portion of the fourth tank passage 6. Accordingly, the refrigerant passed through the downstream passages 2*b* is gathered in the fourth tank passage 6 and is then discharged through the refrigerant outlet pipe 8 to the outside of the evaporator 1*a*. In this first embodiment, an inner diameter of each of the first to fourth tank passages 3 to 6 is formed to be equal to or smaller than 22 mm. Further, it will be understood that a pair of side plates may be attached to both lateral ends of the core portion 11.

Figure 5:
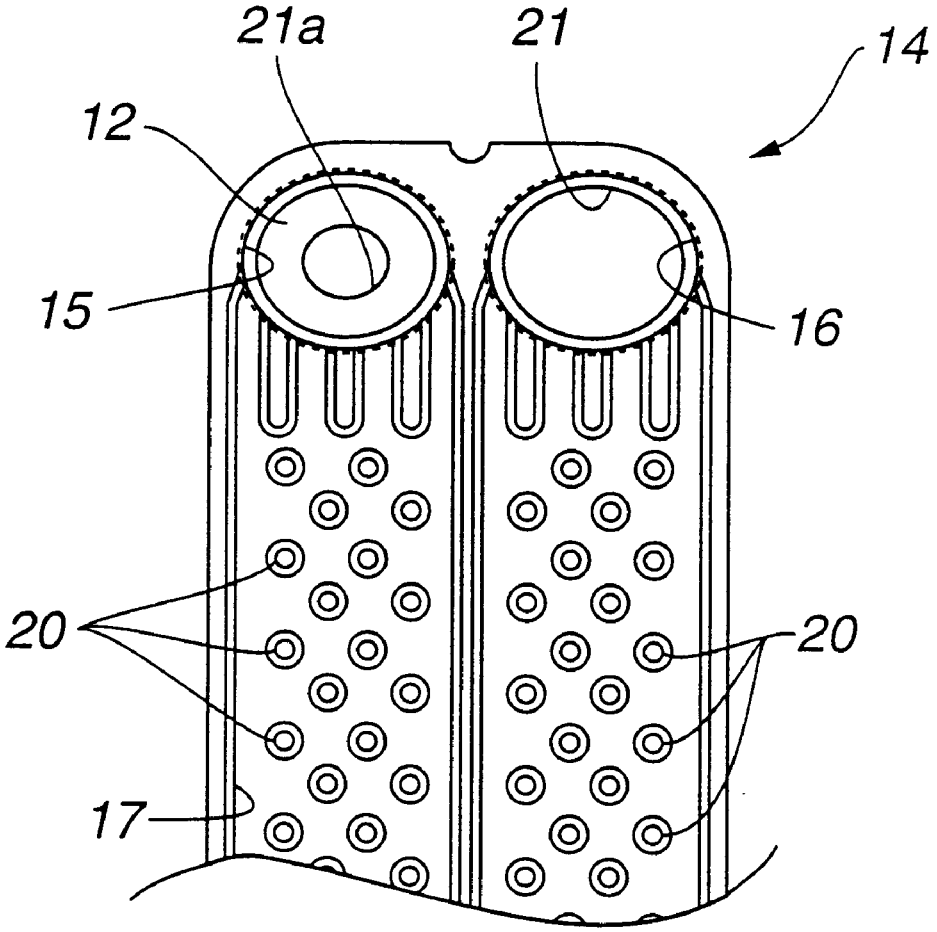
FIG. 5 is a partial view of the metal plate whose port is choked.

Further, a choke portion 12 is provided at a portion between the refrigerant outlet port 10 and the rightmost end of the core portion 11 in the fourth tank passage 6. The choke portion 12 functions to restrict the refrigerant to be excessively supplied to the right-side passages of the downstream passages 2*a*. More specifically, the choke portion 12 in the fourth tank passage 6 is provided by forming a small hole 21*a* at the first deep depressed portion 15 of the one metal plate 14 of the heat-transfer tube element 13 as shown in FIG. 5. A diameter of the smaller hole 21*a* is smaller than the other holes 21 of the other metal plates 14 for defining the tank passages 3 to 6. The diameter of the small hole 21*a* may be properly determined according to the location of the choke portion 12 in the fourth tank passage 6 and the flow-rate of the refrigerant. As is clearly shown in FIG. 2, no choke portion is provided in the third tank passage 5, but the choke portion 12 is provided at a place between the refrigerant outlet port 10 and the rightmost end of the core portion 11 in the fourth tank passage 6. Additionally, the pair of the choke portions 12*a* are provided at the first central portion between the refrigerant inlet port 9 and the leftmost portion of the core portion 11 in the first tank passage 3 and the second central portion between the refrigerant inlet port 9 and a partition portion of the first tank passage 3 and the fourth tank passage 6, respectively.

When the evaporator 1*a* of the first embodiment operates as an element of an automotive air-conditioner, the refrigerant in a liquid state or liquid-vapor mixed state is supplied to the first tank passage 3 through an expansion valve and the refrigerant inlet port 9. The refrigerant supplied to the first tank passage 3 flows in the lateral direction corresponding to the direction shown by the arrows A in FIG. 1, and is properly divided to the respective heat-transfer tube elements 13 owing to the provision of the choke portions 12*a*. Then, the refrigerant flows through the upstream passages 2*a* in the direction of the arrows B shown in FIG. 1 toward the second tank passage 4. The refrigerant reached to the second tank passage 4 flows in the direction of the arrows C shown in FIG. 1 toward the third tank passage 5, and further flows in the third tank passage 5 in the direction of arrow D to be distributed into the downstream passages 2*b*. Further, the refrigerant flows through the downstream passages 2*b* in the direction shown by arrows E shown in FIG. 1 toward the fourth tank passage 6. The refrigerant reached to the fourth tank passage 6 flows in the direction of arrows F shown in FIG. 1 toward the refrigerant outlet port 10. The refrigerant passed through the evaporator 1*a* is delivered to a compressor through a conduit.

The evaporator 1*a* of the first embodiment according to the present invention is arranged such that there is provided a choke portion 12 for decreasing a cross-sectional area of a refrigerant flow passage in the lateral direction (direction $\alpha$) of the fourth tank passage 6. The choke portion 12 functions as a flow resistance (pressure loss) of both side passages 2*b* and 2*a* so that the refrigerant in the third tank passage 5 equivalently flows through the upstream and downstream passages 2*b* and 2*a* of the second half portion of the core portion 11. That is, the back pressure of several of the downstream passages 2*b* located between the choke portion 12 and the rightmost end of the core portion 11 becomes high. Therefore, in spite of the rushing flow of the refrigerant flowed into the third tank passage 5, the refrigerant is equivalently distributed to the downstream passages 2*b* so as to avoid the refrigerant from being excessively supplied to part of the downstream passages 2*b*.

For example, in case of a conventional evaporator which does not provide the choke portion 12 in the fourth tank passage, the refrigerant in liquid state is largely supplied to the several downstream passages 2*b* located near the rightmost end due to the inertia of the liquid refrigerant. This generates a drift of the refrigerant flow among the downstream passages 2*b*, and therefore the conventional evaporator generates a problem such that at a hatching area of FIG. 7 near the center of the evaporator in the second half core, the heat exchange between the refrigerant and the air is insufficiently executed. That is, in case of this conventional evaporator cannot sufficiently and equivalently cool the air passing through the core portion 11.

Figure 6:
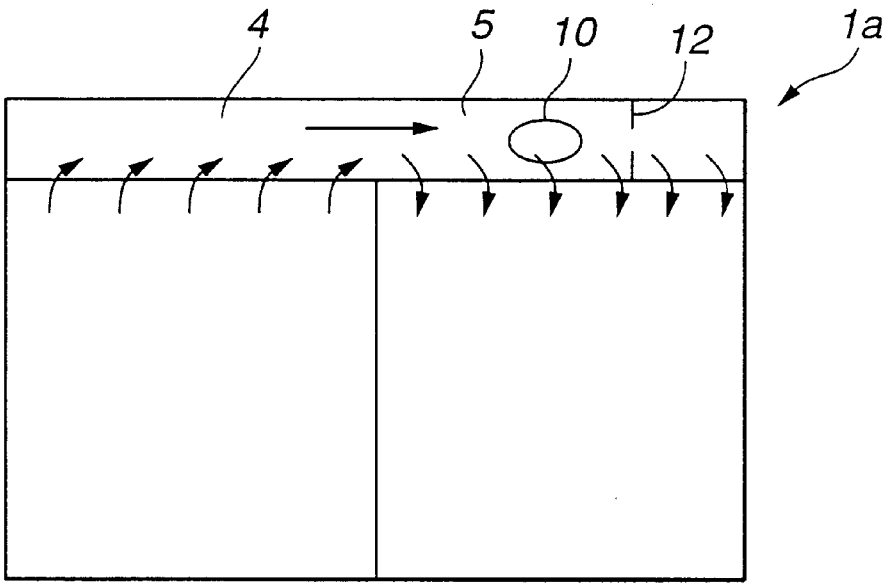
FIG. 6 is a schematic view showing a refrigerant flow in a core through second and third tanks.
Figure 7:
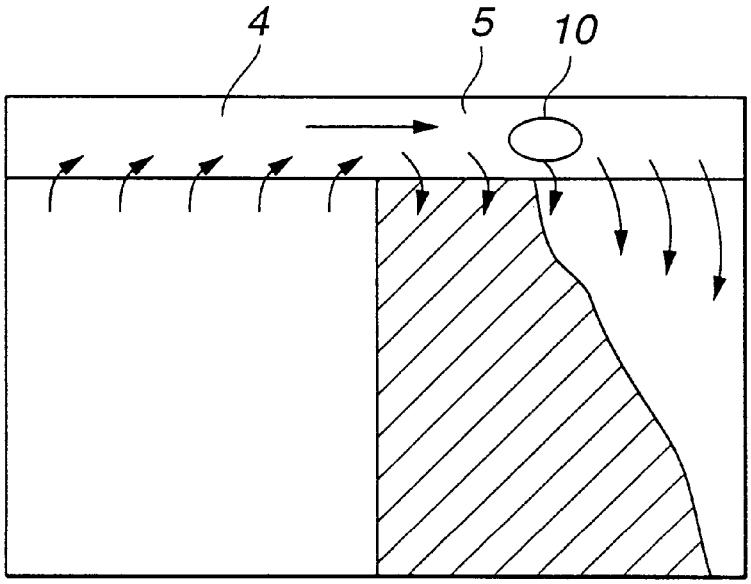
FIG. 7 is a schematic view showing a refrigerant flow in a core through second and third tanks.

In contrast to this, the evaporator 1*a* according to the present invention is arranged to suppress the drift of the refrigerant flow in the downstream passages 2*b* so as to sufficiently and equivalently cool the air passing through the core portion 11 of the evaporator 1*a*, as shown in FIG. 6. Furthermore, even if a flow speed of the refrigerant is accelerated in the fourth tank passage 6 after the refrigerant passed through the downstream passages 2*b*, the provision of the choke portion 12 in the fourth tank passage 6 never promotes the drift of the refrigerant flow in the several downstream passages 2*b* located between the choke portion 12 and the rightmost end of the core portion 11.

Furthermore, the evaporator 1*a* of the first embodiment according to the present invention is arranged to install the choke portion 12 in the fourth tank passage 6 where the refrigerant flow is most table among the first to fourth tank passages 3 to 6. It becomes possible to suppress the noise due to the refrigerant flow. That is, since the refrigerant simply flows in the fourth tank passage 6 from the outlets of the downstream passages 2*b* to the refrigerant outlet port 8, the refrigerant flow in the fourth tank passage 6 is most stable among the first to fourth tank passages 3 to 6.

Figure 8A:
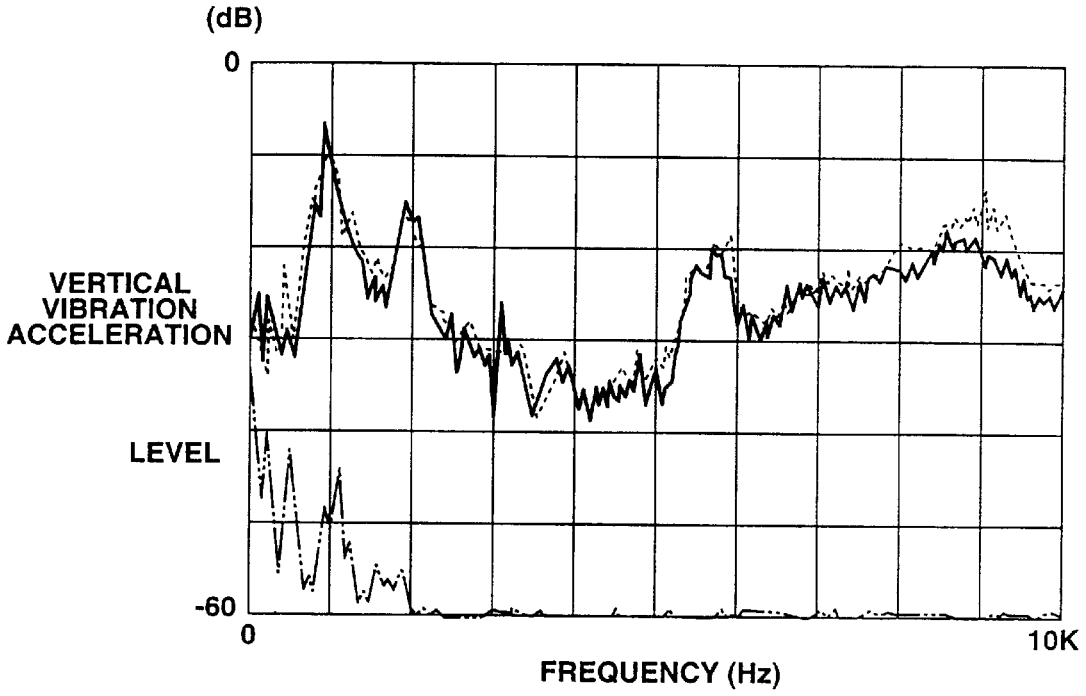
FIGS. 8A and 8B are graphs showing vertical vibration levels at the first tank passage.
Figure 8B:
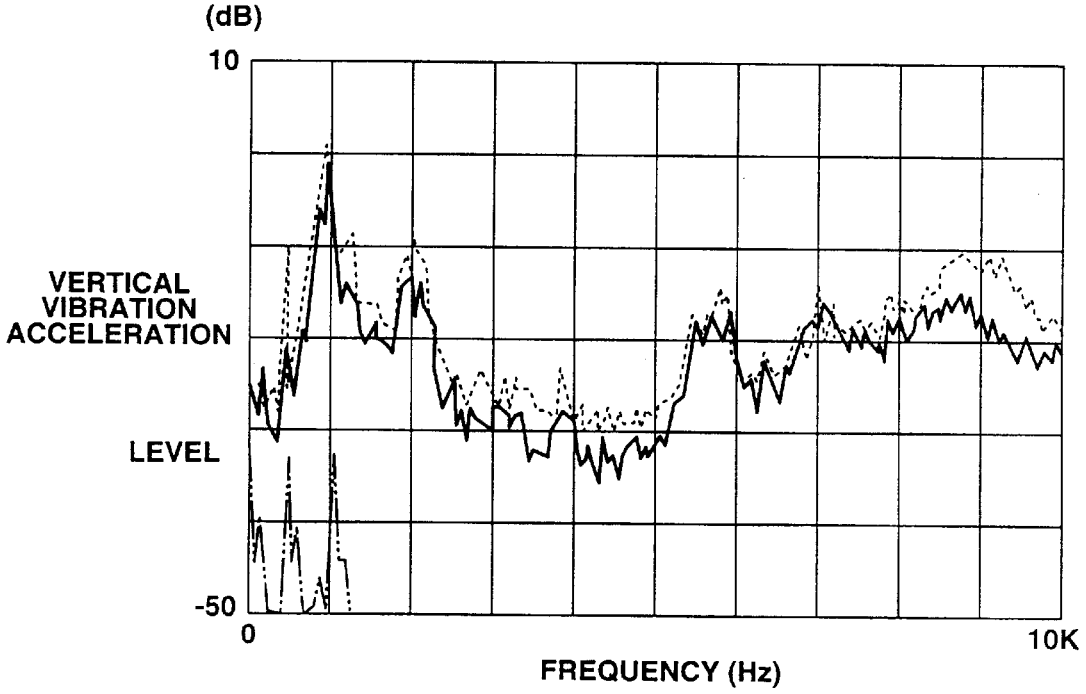
Figure 9A:
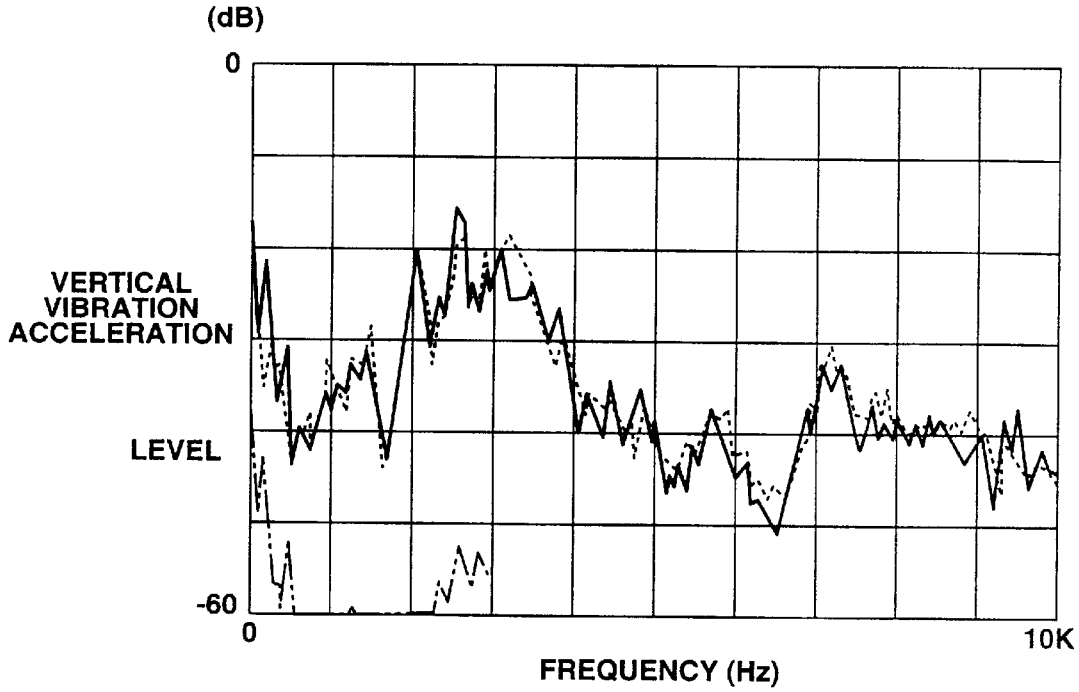
FIGS. 9A and 9B are graphs showing vertical vibration levels at the second tank passage.
Figure 9B:
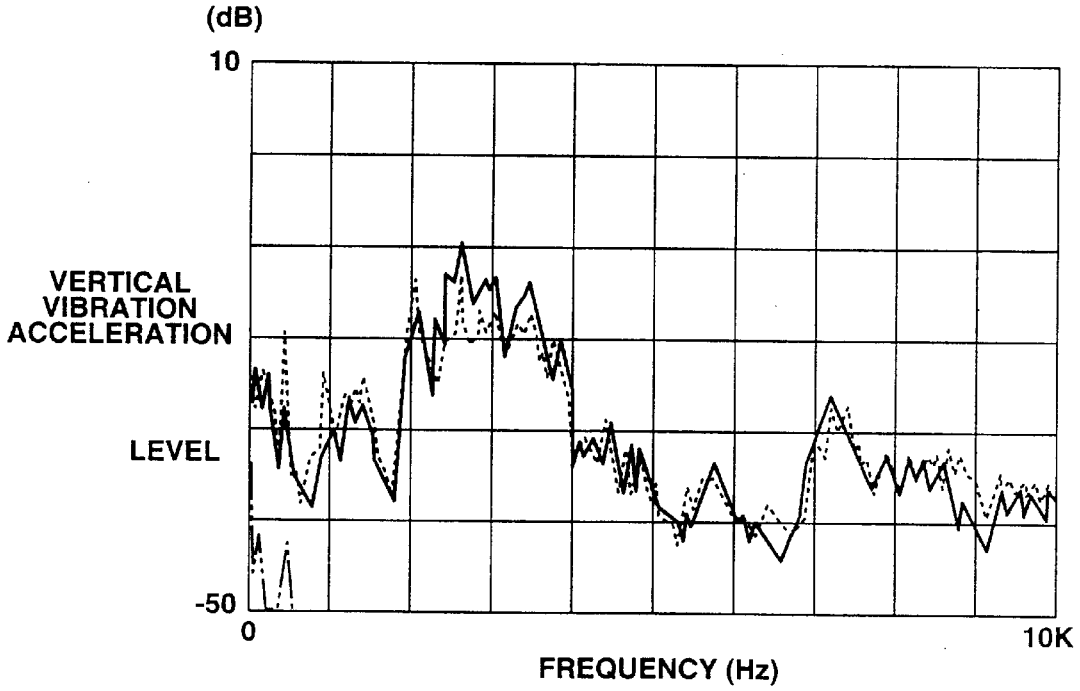
Figure 10A:
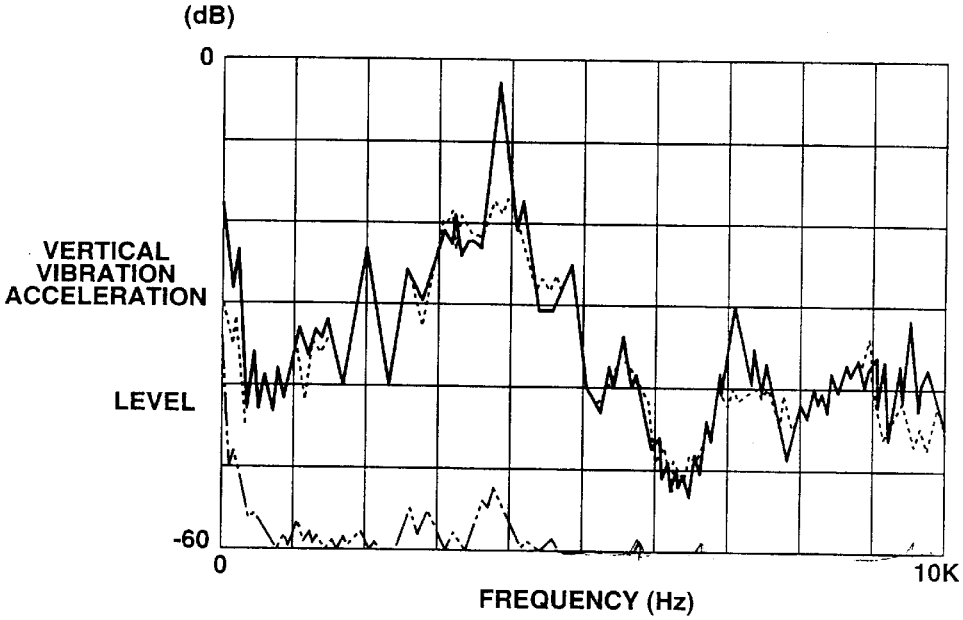
FIGS. 10A and 10B are graphs showing vertical vibration levels at the third tank passage.
Figure 10B:
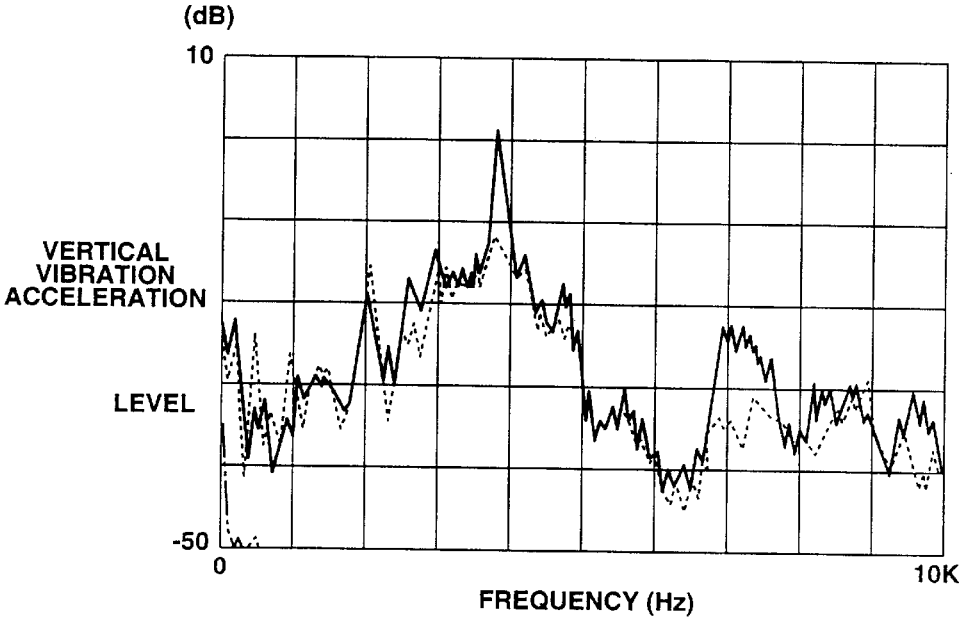
Figure 11A:
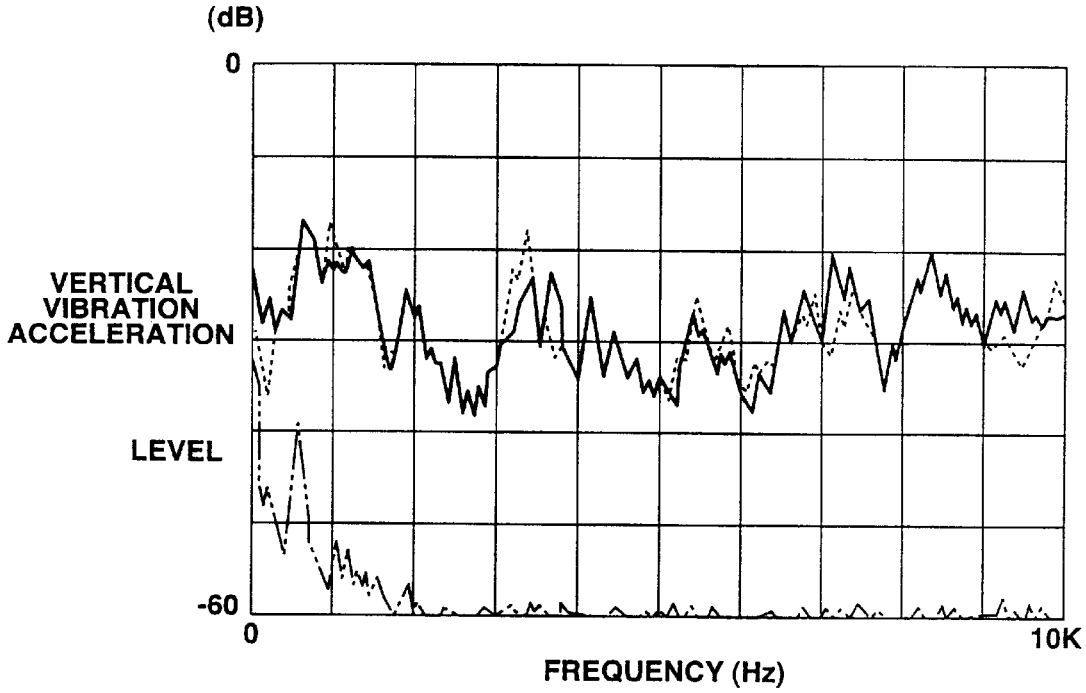
FIGS. 11A and 11B are graphs showing vertical vibration levels at the fourth tank passage.
Figure 11B:
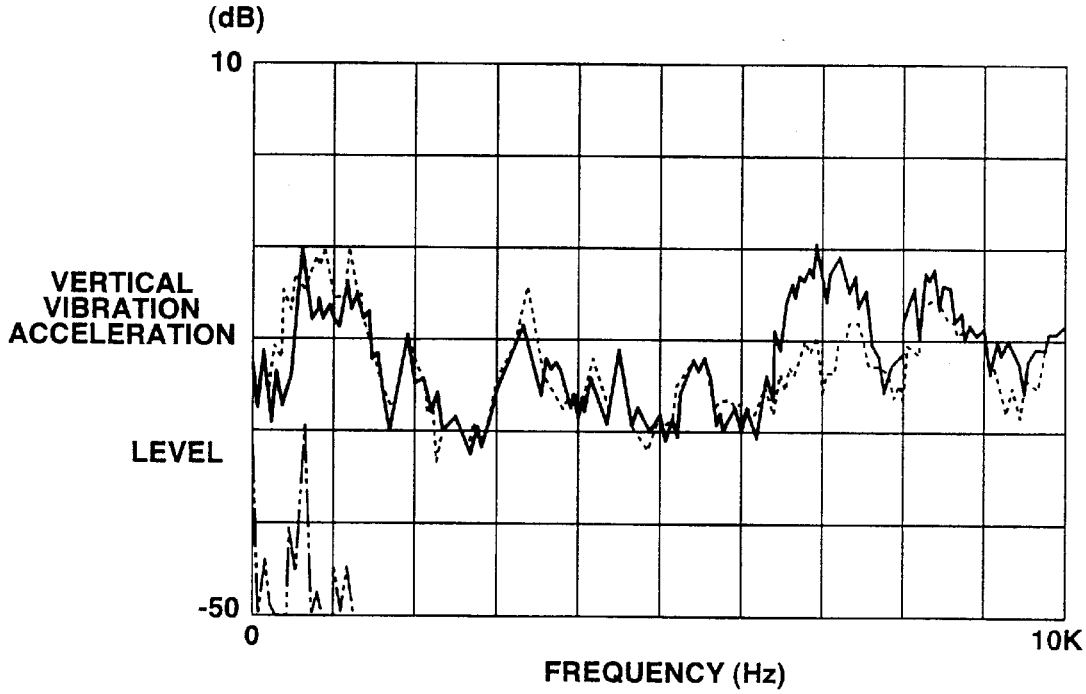

The inventors of the present invention carried out an experiment for measuring a vibration acceleration level at the first to fourth tank passages 3 to 6 during the operation of the evaporator 1*a*, in order to confirm that the refrigerant generates the most stable flow in the fourth tank passage 6. FIG. 8A shows the vibration level at the first tank passage 3 when the compressor is rotated at 900 rev/min (rpm), and FIG. 8B shows the vibration level at the first tank passage 3 when the compressor is rotated at 1500 rev/min (rpm). FIG. 9A shows the vibration level at the second tank passage 4 when the compressor is rotated at 900 rev/min. (rpm), and FIG. 9B shows the vibration level at the second tank passage 4 when the compressor is rotated at 1500 rev/min (rpm). FIG. 10A shows the vibration level at the third tank passage 5 when the compressor is rotated at 900 rev/min (rpm), and FIG. 10B shows the vibration level at the third tank passage 5 when the compressor is rotated at 1500 rev/min (rpm). FIG. 11A shows the vibration level at the fourth tank passage 6 when the compressor is rotated at 900 rev/min (rpm), and FIG. 10B shows the vibration level at the fourth tank passage 6 when the compressor is rotated at 1500 rev/min (rpm). In the graphs of FIGS. 8A to 11B, continuous lines denote the results under a stable state after a predetermined time period elapsed from the start of the compressor, and dotted lines denote the results under a unstable state just after the start of the compressor. As is clear from the graphs of FIGS. 8A to 11B, the experiment proved that the refrigerant flow in the fourth tank passage 6 was most table among the first to fourth tank passages 3 to 6 of the evaporator 1*a*, and the refrigerant flow in the third tank passage 5 was most unstable among the first to fourth tank passages 3 to 6.

Accordingly, the present invention is arranged such that the choke portion 12 is installed in the fourth tank passage 6 where the refrigerant stably flows and that no choke portion is installed in the third tank passage 5 where the refrigerant unstably flows. This arrangement functions to suppress noise due to refrigerant flow from becoming large. Consequently, the evaporator 1*a* of the first embodiment according to the present invention performs to suppress the noise due to the refrigerant flow, to suppress the drift of the refrigerant flow in the evaporator 1*a*, to sufficiently ensure the heat exchanger capacity, and to sufficiently and equivalently cool the air passing through the core portion 11.

Further, the first embodiment is arranged such that the choke portions 12*a* are disposed at a first central portion between the refrigerant outlet port 10 and the first side end of the fourth tank passage 6 and at a second central portion between the refrigerant outlet port 10 and the second side end of the fourth tank passage 6, respectively. This arrangement of the choke portions 12*a* prevents the refrigerant from being excessively supplied to the laterally end-side passages of the core portion 11 and suppresses the drift of the refrigerant flow in the evaporator 1*a* as a whole.

Furthermore, since the first embodiment is arranged such that the choke portions 12*a* are disposed in the first tank passage 3 as similar to the choke portion 12 in the fourth tank passage 6, the refrigerant flow in the core portion 11 is further improved to achieve an equivalent flow among passages by suppressing the refrigerant from mainly flowing at the end-side passages. Further, this arrangement contributes the suppression of noise due to refrigerant flow as is clear from FIGS. 8A to 11B. The choke portions 12*a* may be facilitated to be installed in the first tank passage 3 so that the noise due to the refrigerant flow will be further improved.

Figure 12A:
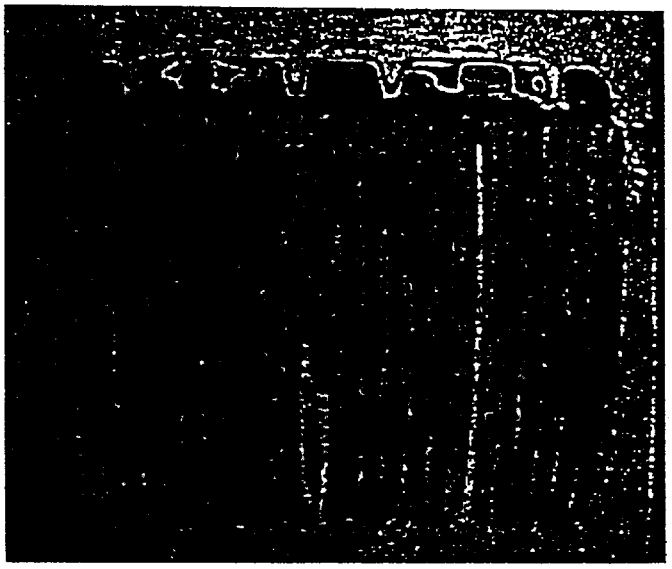
FIGS. 12A and 12B are thermographs of the evaporator according to the present invention and a conventional evaporator.
Figure 12B:
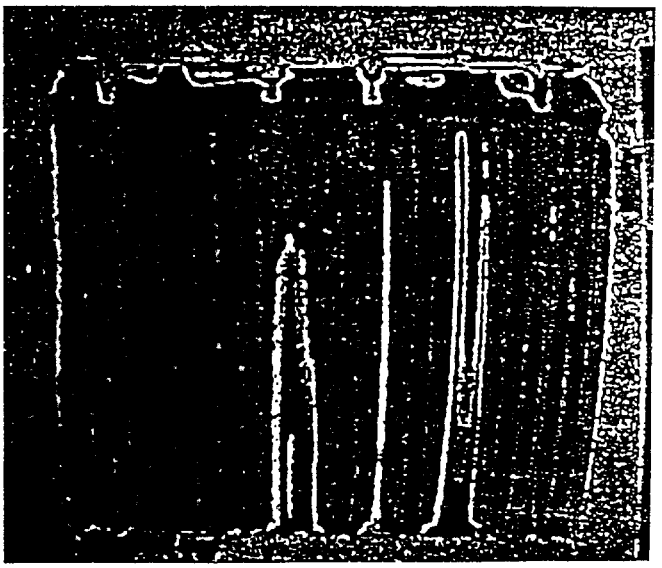

The inventors of the present invention further carried out another experiment for confirming the advantages of the evaporator 1*a* of the first embodiment according to the present invention. This second experiment was carried out in order to inspect the degree of the drift of the refrigerant flow in the evaporator 1*a* by measuring a surface temperature of the evaporator 1*a* under an operating condition by means of a thermograph. FIG. 12A shows a thermograph at a front surface of the evaporator 1*a* according to the present invention under an operating condition. FIG. 12B shows a thermograph at a front surface of the conventional evaporator under an operating condition. The conventional evaporator is arranged to install two choke portions in a third tank passage. In the thermographs, a dark portion represents that the temperature thereat is low, and a bright portion represents that the temperature thereat is high. More specifically, darker a surface of the evaporator becomes, lower the temperature thereof becomes. On the other hand, brighter portion a surface of the evaporator becomes, higher the temperature thereof becomes.

Accordingly, as clear from a comparison between the thermographs of the evaporator 1*a* according to the present invention and the conventional evaporator of FIGS. 12A and 12B, the thermograph of FIG. 12B shows that several portions of the surface thereof are turned bright, and the thermograph of FIG. 12A of the evaporator 1*a* according to the present invention shows that almost whole surface of the evaporator 1*a* is equivalently dark. This result means that the evaporator 1*a* according to the present invention operates so as to equivalently flow refrigerant in the passages 2*a* and 2*b* and that the conventional evaporator includes several portions where the temperature of the surface of the core is high and therefore the conventional evaporator tends to generate drift of the refrigerant flow. Consequently, the result proved that the evaporator 1*a* according to the present invention was improved so as to further equivalently flow refrigerant in the passages 2*a* and 2*b* of the core portion 11 as compared with the convention evaporator. This improvement enables a further improved cooling performance for cooling air by means of the evaporator 1*a*.

Figure 13:
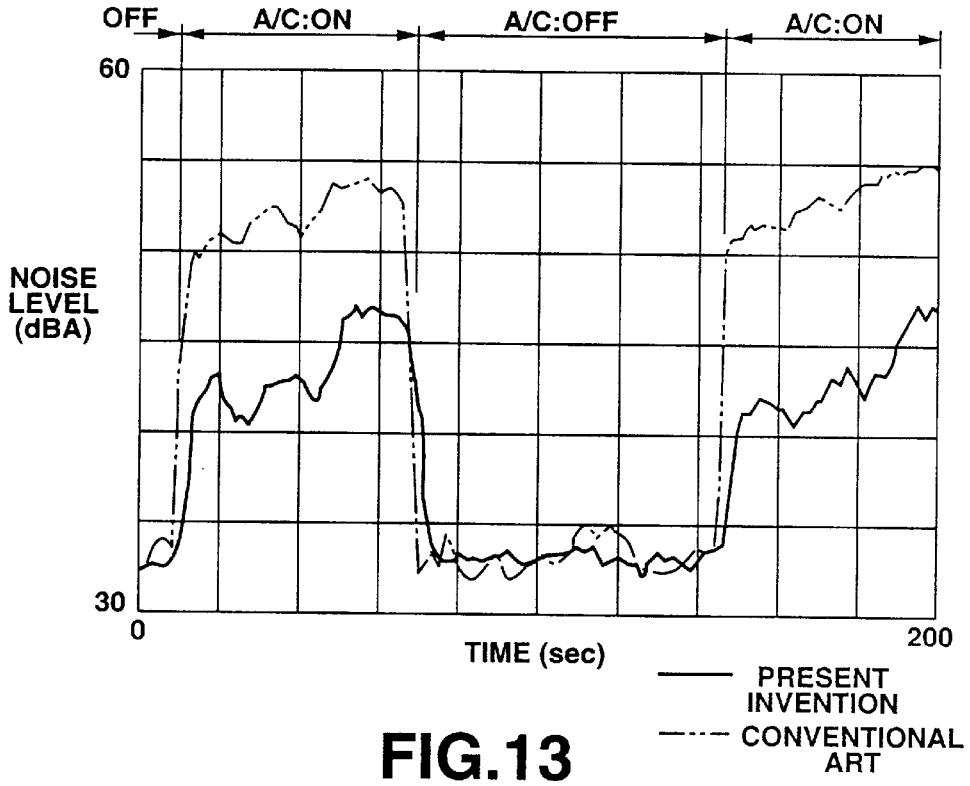
FIG. 13 is a graph showing noise level at the third tank passage of the evaporator.
Figure 14:
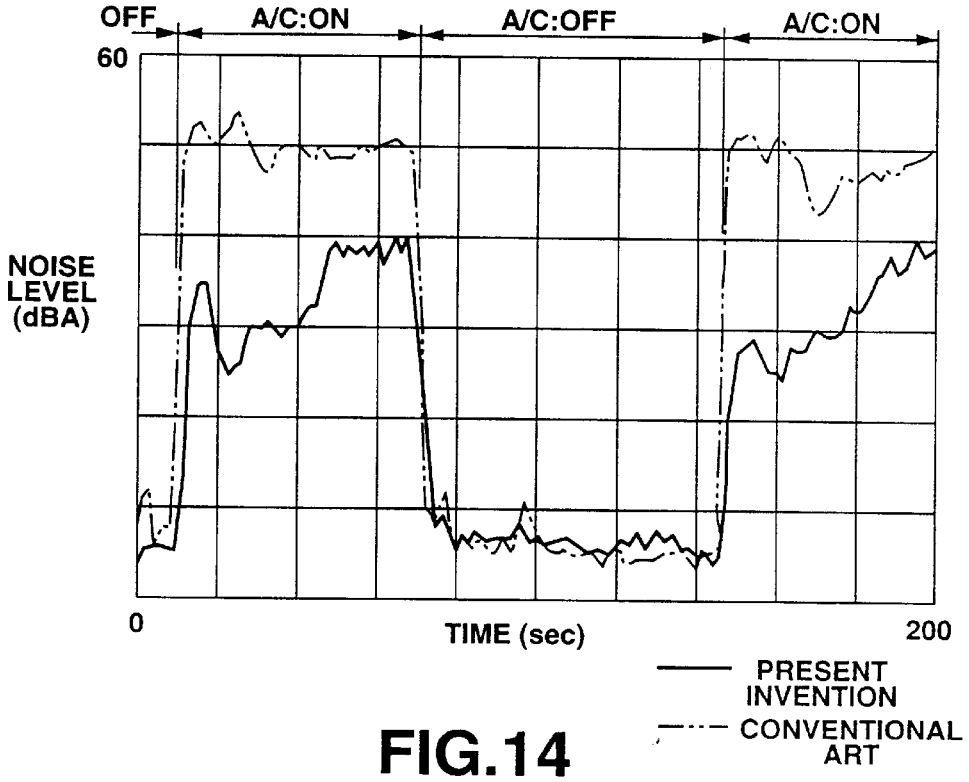
FIG. 14 is a graph showing noise level at the fourth tank passage.

Furthermore, the inventors of the present invention also carried out the experiment as to noise of the evaporator during operation. Level of noise generated in the vicinity of the evaporator 1*a* according to the present invention was measured. FIGS. 13 and 14 represents noise levels of the evaporator 1*a* according to the present invention and a conventional evaporator under an operating condition. In FIGS. 13 and 14, continuous lines show the performance of the evaporator 1*a* according to the present invention, and two-dot chain lines show the performance of the conventional evaporator. Further, FIG. 13 shows a result when the compressor is rotated at 900 rev/min (rpm), and FIG. 14 shows a result when the compressor is rotated at 1500 rev/min (rpm).

As is clearly known from the comparison between the present invention and the conventional art, the noise level of the present invention is suppressed as compared with that of the conventional art. That is, the evaporator 1*a* according to the present invention functions to suppress the noise due to the refrigerant flow small so as to reduce noise level. Although slight noises are generated even during a compressor stopping state, this noise is caused by the air-flow passing through the evaporator 1*a* and is not detected and not noisy for persons.

Referring to FIGS. 15 to 21, there is shown a second embodiment of the evaporator 51*a* according to the present invention. The second embodiment is specifically arranged such that the first to fourth tank passages 53 to 56 and the upstream and downstream passages 52*a* and 52*b* are defined by different members. That is, the first to fourth tank passages 53 to 56 are defined by a pair of flange plates 81 and a pair of tank members 82*a* and 83*b*. The upstream and downstream passage 52*a* and 52*b* are defined by a plurality of heat-transfer tube elements 74.

Figure 20:
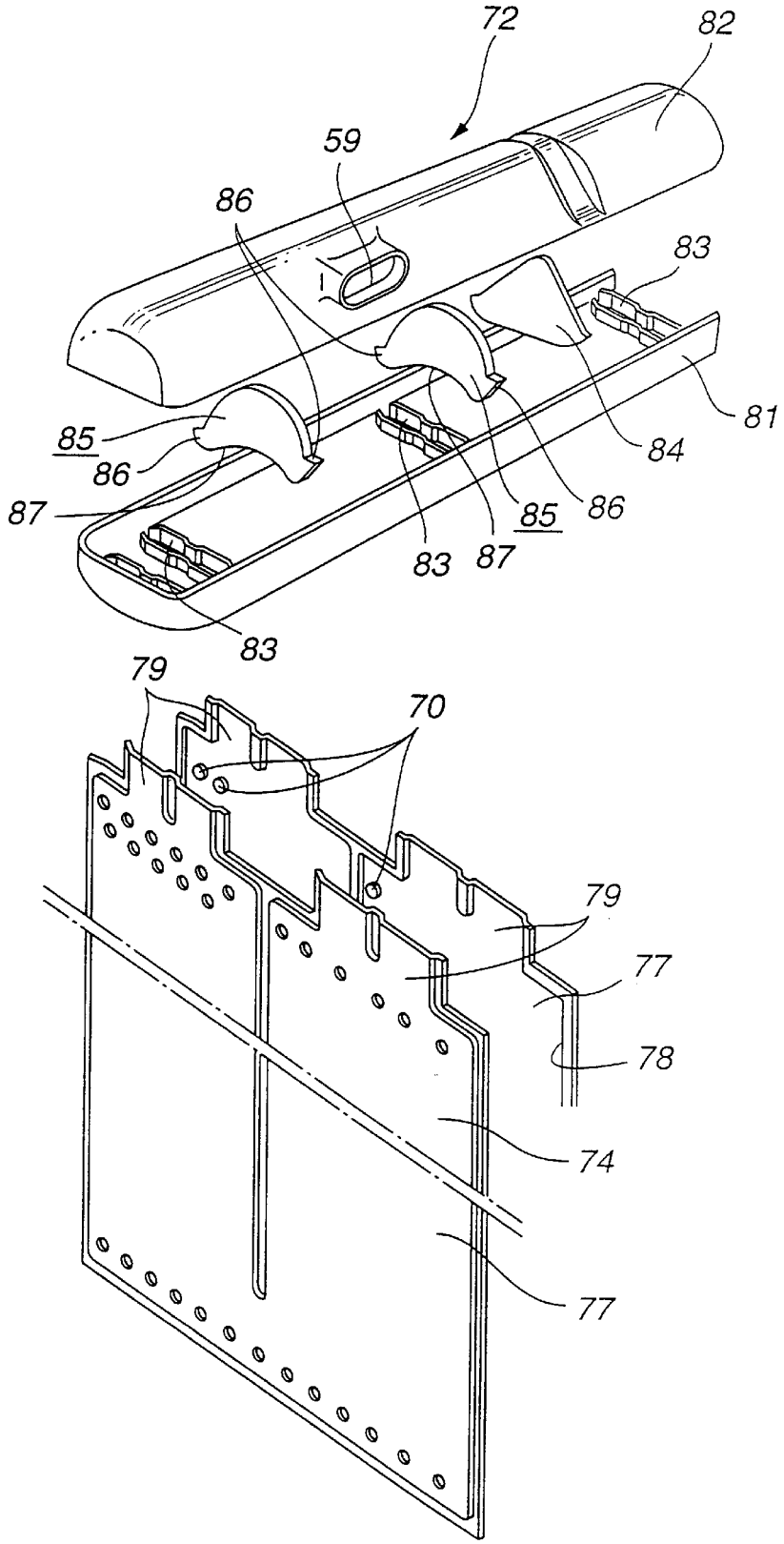
FIG. 20 is an exploded perspective view of the evaporator of FIG. 15.
Figure 21:
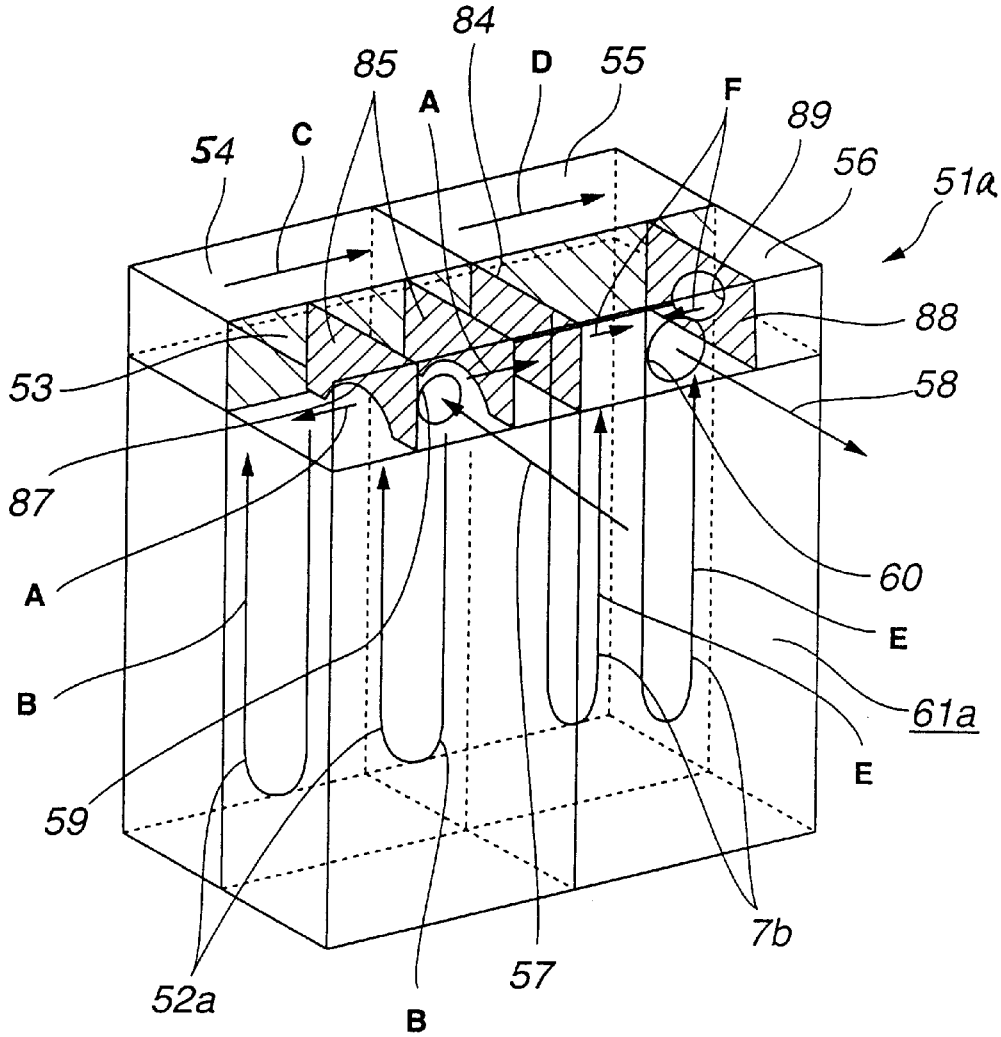
FIG. 21 is a schematic view showing a refrigerant flow in the evaporator of the second embodiment.
Figure 22:
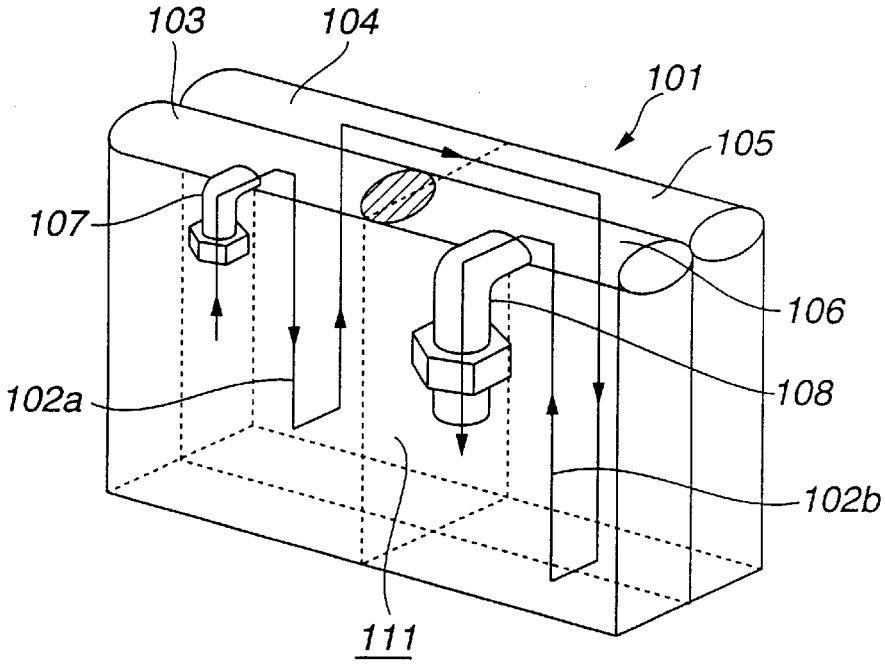
FIG.22 (PRIOR ART)
FIG. 22 is a schematic perspective view of a conventional evaporator.
Figure 23:
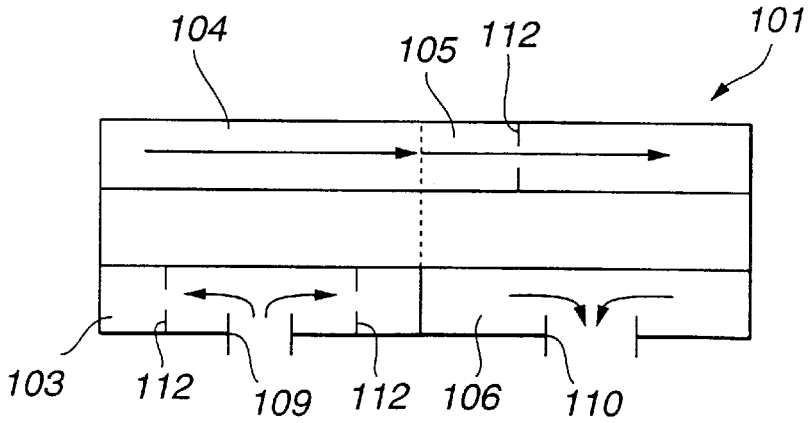
FIG.23 (PRIOR ART)
FIG. 23 is a cross sectional view of tank passages of the conventional evaporator of FIG. 21.

A core 61*a* of the evaporator 51*a* of the second embodiment is constructed by a plurality of outer fins 75, a pair of side plates 76 and the plurality of heat-transfer tube elements 74. As shown in FIG. 20, each heat-transfer tube element 74 is constituted by a pair of metal plates 77. As is similar to the metal plate 14 of the first embodiment, each metal plate 77 is produced by press-forming a clad sheet of aluminum alloy. The heat-transfer tube element 74 is produced by oppositely stacking the pair of metal plate 77 so that the depressed portions of the pair of metal plates 77 form a refrigerant passage therebetween. Then, the pair of metal plates 77 are integrally connected with each other by means of brazing.

The peripheral portion of the metal plate 74 is fixedly and integrally connected to that of the other metal plate 74 by means of brazing to define a U-shaped passage functioning as an upstream passage 72*a* or the downstream passage 72*b*. The metal plate 77 is made from a so-called double-face clad sheet. By press-forming the sheet, a pair of projecting portions 29 are formed at upper periphery while being separated with each other as shown in FIG. 20. Simultaneously, a U-shaped depressed portion 78 is produced so that both ends of the U-shaped depressed portions 78 defining the passage are continuous to the both projecting portions 79.

The projecting portions 79 of each heat-transfer tube element 74 are inserted to insertion holes 80 of the flange plates 81, respectively. Each heat-transfer tube element 74 is produced by stacking the pair of metal plates 77 oppositely to form a space therebetween and by integrally connected their peripheries by means of brazing. The both U-shaped depressed portions 78 of the brazed metal plates 77 constitute the U-shaped passage functioning as the upstream passage 52*a* or downstream passage 52*b*. A pair of insert portions 30 are also produced simultaneously with the forming of the U-shape passage. Further, a large number of embossed portions 70 are press-formed at the U-shaped depression 28 so as to be integrally connected to the embossed portions 70 formed on the other U-shaped depressed portion 78 of the opposite metal plate 77 by brazing. The integral connection between the embossed portions 70 between the oppositely stacked metal plates 77 function to improve the pressure durability and to promote the turbulence of the refrigerant flow in the U-shaped passage of the heat-transfer tube elements.

First and second tanks 72 and 73 are produced from a pair of flange plates 81 and first and second tank members 82*a* and 82*b* which are produced by press-forming a clad sheet of aluminum alloy. The first tank 72 is produced by assembling the flange plate 81 and a front tank member 82*a* and by sealing connecting the contacting peripheral portions of the flange plate 81 and the first tank member 82*a* by means of brazing. Similarly, the second tank 73 is produced by assembling and brazing the flange plate 81 and the second tank member 82*b*. The flange plate 81 has a plurality of connection holes 83 formed into a slit-shape as shown in FIG. 20. The insert portions 80 of the respective heat-transfer tube elements 74 are fittingly inserted to the connecting holes 83, respectively. Further, the first tank member 82*a* has a refrigerant inlet port 59 and a refrigerant outlet port 50 connected to a refrigerant inlet pipe 57 and a refrigerant outlet pipe 58, respectively. During the assembling of the flange plate 81 and the first tank member 82*a*, a partition plate 84 is installed at a central portion in the longitudinal direction of the first tank 72 as shown in FIG. 20. This installation of the partition plate 84 divides the first tank 72 into a first tank passage 53 through which refrigerant is supplied to the upstream passages 52*a* and a fourth tank passage 56 from which the refrigerant is flowed out. That is, the first tank passage 53 includes the refrigerant inlet port 59, and the fourth tank passage 56 includes the refrigerant outlet port 60.

The evaporator 51*a* of the second embodiment is produced by assembling the pair of the flange plates 81 with the first and second tank members 82*a* and 82*b* to construct the first and second tanks 72 and 73, by inserting the insert portions 80 of the heat-transfer tube elements 72 to the connecting holes 83 of the flange plates 81, by sandwiching the outer fins 75 between the adjacent heat-transfer tube elements 74, respectively, and by attaching the side plates 76 to the both side-end portions. Then, the assembled members 81, 82*a*, 82*b*, 74, 75 and 76 are integrally connected by means of brazing.

Figure 18:
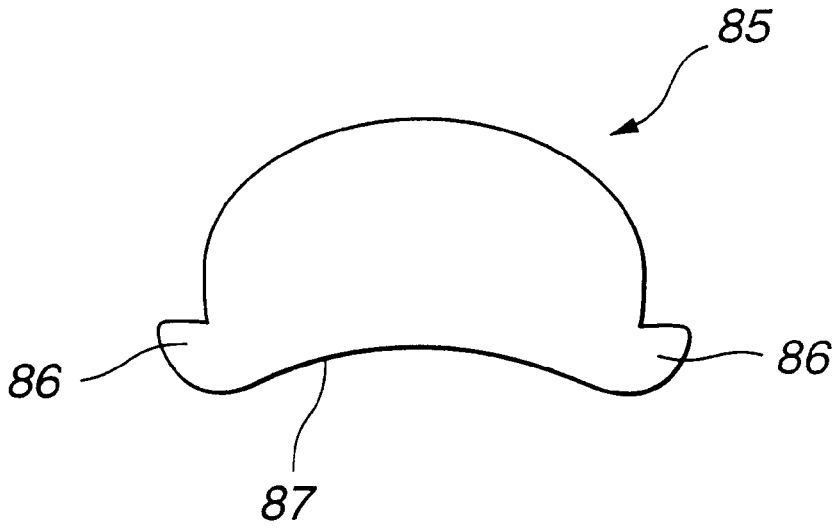
FIG. 18 is a plan view of a choke plate installed in the first tank passage of the evaporator of FIG. 15.

Specifically, the evaporator 51*a* of the second embodiment is arranged to fixedly install a pair of choke plate 85 formed into a shape shown in FIG. 18 in the first tank passage 72. That is, an upper periphery of the choke plate 85 is formed to follow a shape along an inner surface of the first tank member 82*a* and has a pair of fixing portions 86. The fixing portions 86 are fixed installed by a lower ends of the first tank member 82*a* when the first tank member 82*a* is assembled with the flange plate 72. Further, a lower end periphery of the choke plate 85 is formed into an arc-shaped depression 87 as shown in FIG. 18. The choke plates 85 are located at a first central portion between the refrigerant inlet port 59 and a leftmost end portion and a second central portion between the refrigerant inlet port 59 and the partition plate 84, respectively.

Figure 15:
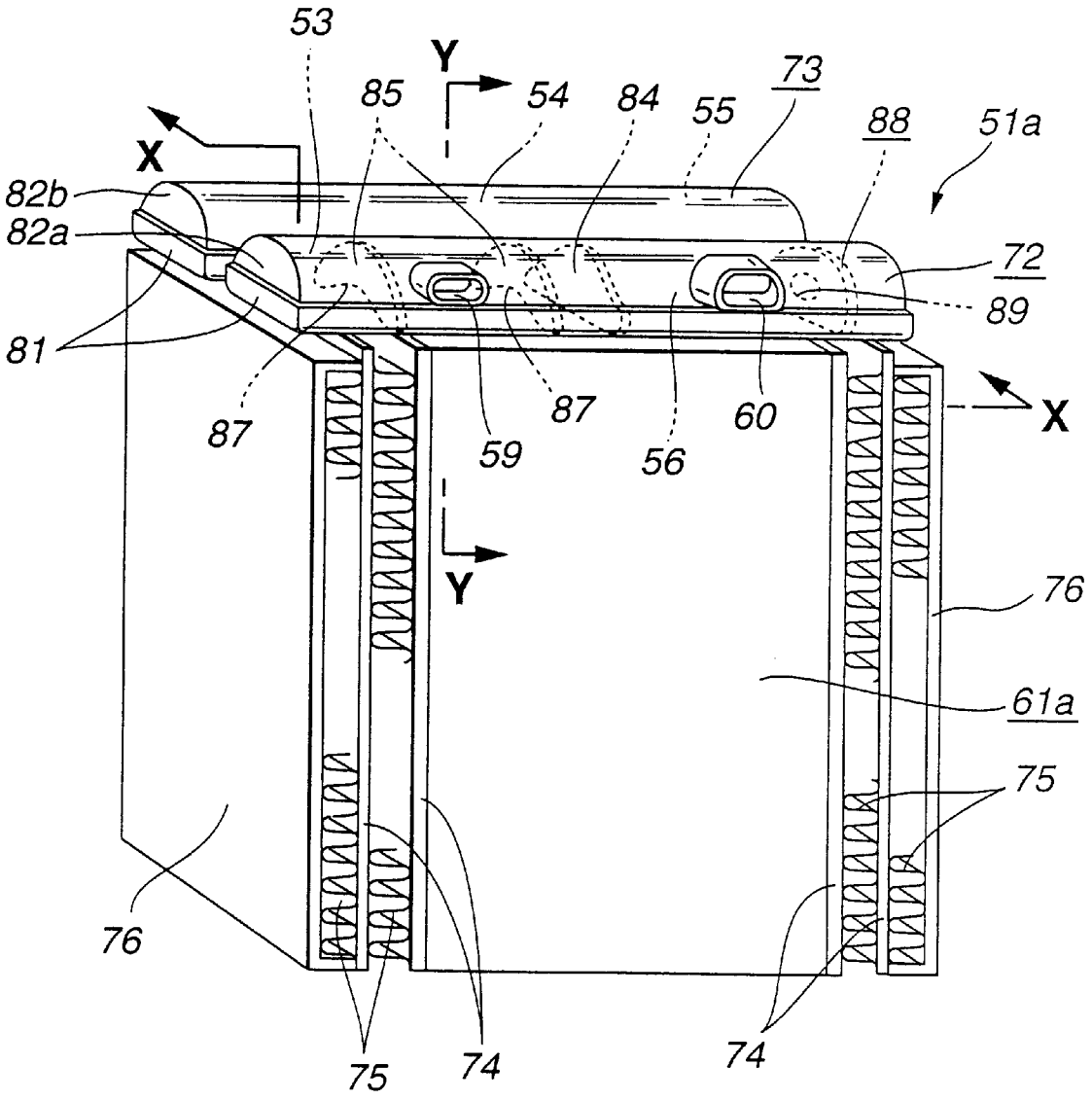
FIG. 15 is a perspective view of the evaporator of a second embodiment according to the present invention.
Figure 16:
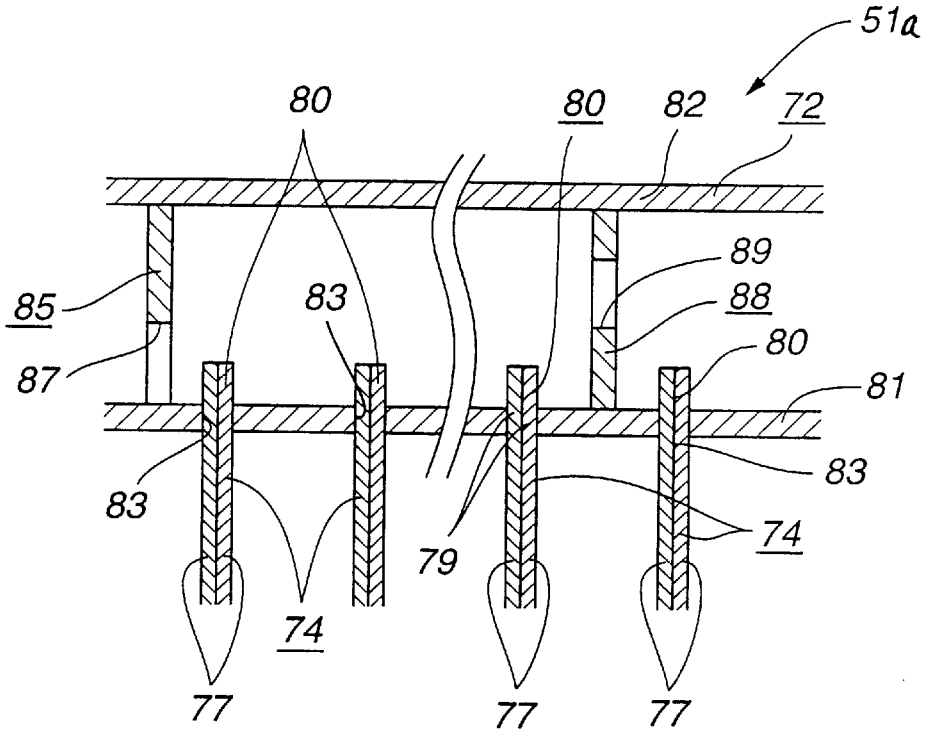
FIG. 16 is a cross-sectional view taken in a direction of arrows substantially along the line X—X of FIG. 15.
Figure 17:
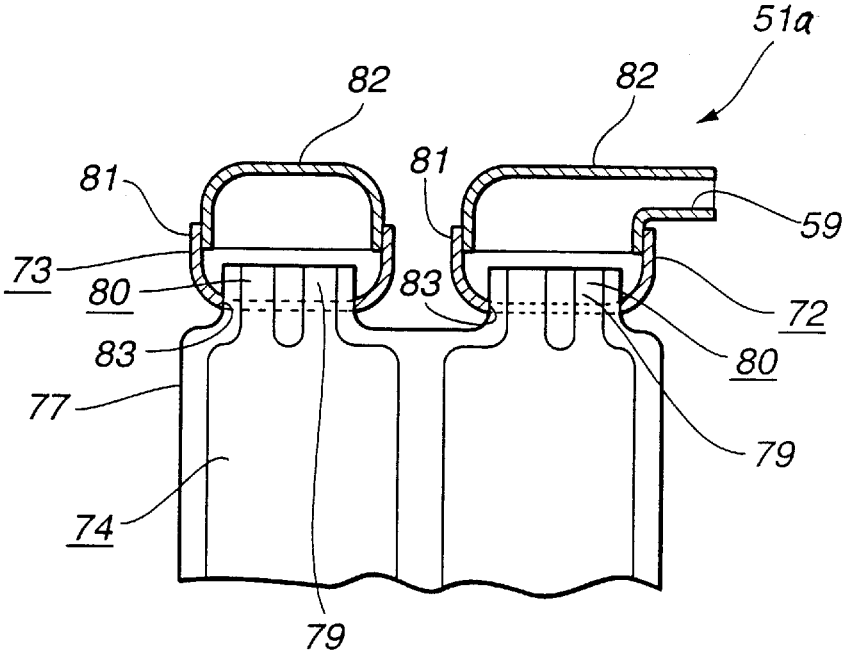
FIG. 17 is a cross-sectional view taken in a direction of arrows substantially along the line Y—Y of FIG. 15.
Figure 19:
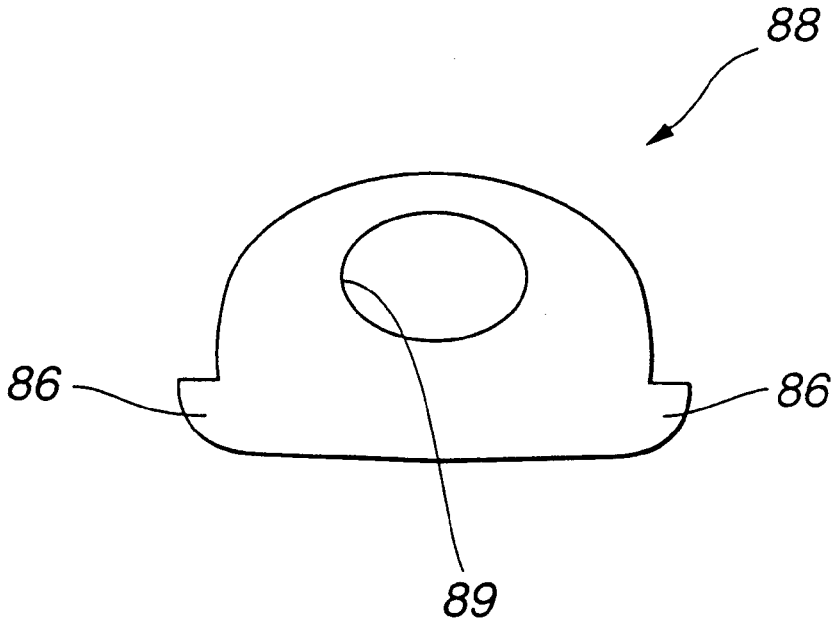
FIG. 19 is a plan view of a choke plate installed in the fourth tank passage of the evaporator of FIG. 15.

Further, a second choke plate 88 is installed at a third central portion between the refrigerant outlet port 60 and a rightmost end of first tank 72 in the fourth tank passage 56 as shown in FIG. 15. The second choke plate 88 is formed into a shape shown in FIG. 19. As is similar to the shape of the first choke plate 85, the upper periphery of the second choke plate 88 has a semi-circular shape along an inner surface of the first tank member 82*a*, a pair of fixing portions 86 are provided so as to be fixedly installed in the fourth tank passage 56 by a lower end of the first tank member 82*a* when the first tank member 82*a* is assembled with the flange plate 72. Further, a lower end periphery of the second choke plate 88 is formed into a generally flat shape along an inner surface of the flange plate 81. Furthermore, a through-hole 89 for restrictingly flowing the refrigerant is formed at a slightly upper and center portion of the second choke plate 88 as shown in FIG. 19, so that the second choke plate 88 functions as a choke portion in the fourth tank passage 56.

As is clearly shown in FIGS. 15 and 20, no choke plate is installed in the second and third tank passages 54 and 55. Further, as shown FIG. 17, the first and second choke plates 85 and 88 are installed in the first and fourth tank passages 53 and 56, respectively, so as to avoid the connecting holes 83. This arrangement prevents the first and second choke plate from interfering with the projection portions 80 of the heat-transfer tube elements 74 in an assembled state.

With the thus arranged second embodiment according to the present invention, since the first and second choke plates 85 and 88 are installed in the first and fourth tank passages 53 and 56 so as to restrict and change the distribution of the refrigerant flow as is similar to the first embodiment, the refrigerant flows through the upstream and downstream passage 52*a* and 52*b* so as to equivalently distribute the refrigerant into the respective heat-transfer tube elements 74. This enables the air passing through the evaporator 51*a* to be equivalently and sufficiently cooled. Furthermore, this arrangement of the first and second choke plates 85 and 88 does not degrade the noise suppressing performance of the evaporator 51*a* of the second embodiment according to the present invention. That is, the evaporator 51*a* of the second embodiment functions to suppress the generation of the noise due to the refrigerant flow. Additionally, the first choke plates 85 are arranged to have an arc-shaped depression 87. The first choke plates 85 effectively function to prevent the liquidized refrigerant, which tends to flow lower portion in the tank passage due to gravity, from being stopped reaching through the choke portion to the heat-transfer tube elements at both side portions. Of course, the first choke plates 85 restrict the refrigerant from excessively flowing to both side end portions in the first tank passage 53 so as to suppress the drift of the refrigerant flow in the first tank passage 53. Furthermore, the other construction and function of the evaporator 51*a* of the second embodiment are as same as those of the first embodiment, and therefore the explanation thereof are omitted herein.

Although the second embodiment according to the present invention has been shown and described to provide the first and second tanks 72 and 73 at an upper end portion of the evaporator 51*a*, it will be understood that the present invention is not limited to this and may be arranged to provide the first and second tanks 72 and 73 at a lower end portion of the evaporator 51*a*. If the first and second tanks 72 and 73 are installed at the lower end portion of the evaporator 51*a*, the first choke plates 85 should be formed so that the arc-shaped depression 87 is formed at a portion facing with the semicircular inner surface of the first tank member 82*a*. Further, in such a case, the first choke plate 85 employed in the second embodiment may be employed instead of the second choke plate 88.

Although the invention has been described above by reference to certain embodiments of the invention, the invention is not limited to the embodiments described above. Modifications and variations of those skilled in the art, in light of the above teachings. The scope of the invention is defined with reference to the following claims.

What is claimed is:

1. An evaporator for an automotive air-conditioner, comprising:

a first core having a plurality of first refrigerant passages and a plurality of first air passages contacted with the refrigerant passages;

a second core having a plurality of second refrigerant passages and a plurality of second air passages contacted with the refrigerant passages;

a first tank passage connected to inlets of the first refrigerant passages of said first core;

a second tank passage connected to outlets of the first refrigerant passages of said first core;

a third tank passage connected to said second tank passage and inlets of the second refrigerant passages of said second core;

a fourth tank passage connected to outlets of the second refrigerant passages of said second core;

a refrigerant inlet connected to said first tank passage;

a refrigerant outlet connected to said second tank passage; and a choke portion installed in said fourth tank passage.

2. The evaporator as claimed in claim 1, wherein the outlets of the second refrigerant passages of the second core are arranged in tandem along a longitudinal direction of said fourth tank passage.

3. The evaporator as claimed in claim 2, wherein said refrigerant outlet is installed at a central portion in the longitudinal direction of said fourth tank passage, and said choke portion is installed at a portion between said refrigerant outlet and an end of said fourth tank passage apart from said first tank passage.

4. The evaporator as claimed in claim 1, further comprising a pair of first-tank choke members installed in said first tank passage, the inlets of the first refrigerant passages of said first core being arranged in tandem along a longitudinal direction of said first tank passage, said refrigerant being installed at a central portion in the longitudinal direction of said first tank passage, and said first-tank choke portions being installed at a first central portion located between said refrigerant outlet and an end of said first tank passage apart from said fourth tank passage and a second central portion located between said refrigerant outlet and an end of said first tank passage near said fourth tank passage.

5. The evaporator as claimed in claim 1, wherein said first and four tank passage are defined by a first tank member and a first flange plate having a plurality of first connecting holes, the first and second refrigerant passages being defined by a plurality pairs of metal plates, the inlets of the first refrigerant passages and the outlets of the second refrigerant passages being inserted to the first connecting holes, said second and third tank passages being defined by a second tank member and a second flange plate having a plurality of first connecting holes, the first and second refrigerant passages being defined by a plurality pairs of metal plates, the outlets of the first refrigerant passages and the inlets of the second refrigerant passages being inserted to the second connecting holes.

6. The evaporator as claimed in claim 5, wherein said choke portion includes a choke plate which is formed such that an upper periphery of the choke plate is in a form as same as an inner surface of the first tank member and a lower periphery of the choke plate is in a form as same as an inner surface of the flange plate and that a through hole is formed in the choke plate.

7. The evaporator as claimed in claim 4, wherein the first-tank choke members includes a pair of first-tank choke plate which is formed such that an upper periphery of the first-tank choke plate is formed to fit with an inner surface of the first tank member and a lower periphery of the choke plate having a depression apart from an inner surface of the flange plate.

8. The evaporator as claimed in claim 1, wherein said first and second cores and said first, second, third and fourth tank passages are made by laminating a plurality of metal plates.

9. The evaporator as claimed in claim 8, wherein said choke portion in the fourth tank passage is defined by forming a hole which is smaller in a diameter than a passage hole for defining said fourth tank passage.

10. An evaporator for an automotive air conditioner, comprising:

first passage defining means defining a plurality of first refrigerant passages;

second passage defining means defining a plurality of second refrigerant passages;

first tank passage means defining a first tank passage, the first tank passage means being fluidly communicated with inlets of the first refrigerant passages;

second tank passage means defining a second tank passage, the second tank passage being fluidly communicated with outlets of the first refrigerant passages;

third tank passage means defining a third tank passage, the third tank passage being fluidly communicated with the second tank passage and inlets of the second refrigerant passages;

fourth tank passage means defining a fourth tank passage, the fourth tank passage being fluidly communicated with outlets of the second refrigerant;

refrigerant inlet means defining a refrigerant inlet, the refrigerant inlet being fluidly communicated with the first tank passage;

refrigerant outlet means defining a refrigerant outlet, the refrigerant outlet being fluidly communicated with the second tank passage; and choke means defining a choked hole, the choke hole being installed in the fourth tank passage.

* * * * *